US008713801B2

(12) United States Patent
Bohmer et al.

(10) Patent No.: US 8,713,801 B2
(45) Date of Patent: May 6, 2014

(54) RAZOR WITH BLADE HEATING SYSTEM

(75) Inventors: William Bohmer, Randolph, NJ (US); Louis D. Tomassetti, Pompano Beach, FL (US)

(73) Assignees: L.P.I. Consumer Products, Inc., Pompano Beach, FL (US); Display Matrix Corporation, Randolph, NJ (US)

( * ) Notice: Subject to any disclaimer, the term of this patent is extended or adjusted under 35 U.S.C. 154(b) by 211 days.

(21) Appl. No.: 13/110,031

(22) Filed: May 18, 2011

(65) Prior Publication Data

US 2012/0291288 A1 Nov. 22, 2012

(51) Int. Cl.

| | |
|---|---|
| ***B26B 19/00*** | (2006.01) |
| ***B26B 11/00*** | (2006.01) |
| ***H05B 1/00*** | (2006.01) |

(52) U.S. Cl.

USPC ..... 30/34.05; 30/140; 219/50

(58) Field of Classification Search

USPC ..... 30/34.05, 140, 50, 169, 346.58, 123; 219/50, 201, 221, 538

See application file for complete search history.

(56) References Cited

U.S. PATENT DOCUMENTS

| | | | | |
|---|---|---|---|---|
| 956,604 | A * | 5/1910 | Savoy | 30/140 |
| 1,291,318 | A * | 1/1919 | White | 30/34.05 |
| 2,622,319 | A * | 12/1952 | Hunt | 30/34.05 |
| 4,207,896 | A * | 6/1980 | Shaw | 606/29 |
| 4,231,371 | A * | 11/1980 | Lipp | 606/31 |
| 6,817,101 | B1 * | 11/2004 | Bohmer | 30/34.05 |
| 6,836,966 | B2 * | 1/2005 | Patrick | 30/34.05 |
| 7,272,991 | B2 * | 9/2007 | Aviza et al. | 76/104.1 |
| 7,681,320 | B2 * | 3/2010 | Szczepanowski et al. | 30/530 |
| 2007/0137050 | A1 * | 6/2007 | Xu et al. | 30/346.54 |
| 2009/0255123 | A1 * | 10/2009 | Tomassetti et al. | 30/34.05 |
| 2009/0288304 | A1 * | 11/2009 | Denkert et al. | 30/346.61 |

* cited by examiner

*Primary Examiner* — Sean Michalski
*Assistant Examiner* — Jonathan G Riley
(74) *Attorney, Agent, or Firm* — Robert M. Downey, P.A.

(57) ABSTRACT

A blade cartridge for a shaving razor contains a series of parallel blades, and at least two wire conductors of an electric circuit connected to the blades at spaced intervals to provide an electric current flow through the blades in a manner that provides more efficient heat distribution across the length of the blades. The ends of the blades may be held in place by staples that are insulated from the electric circuit. A thin conductive film may be fitted to be in contact with the ends of the blades to insure conductivity throughout the entire length of each blade. A radiator effect of the heated blades causes the blades to become warmer when the blades are placed against the skin surface and air is unable to circulate between the blades. The blades become less hot when removed from the skin and air circulates between the blades.

4 Claims, 3 Drawing Sheets

RAZOR WITH BLADE HEATING SYSTEM

BACKGROUND OF THE INVENTION

1. Field of the Invention

The present invention relates to razors for shaving and, more particularly, to a system for electrically heating a series of razor blades within a blade cartridge.

2. Discussion of the Related Art

It is well known that hairs are softened and easier to cut when they are heated just prior to being cut by the sharp cutting edge of a razor blade. It is also well known that the cutting edge of the razor blade is more effective in cutting hairs when the blade is warm or hot. Just prior to shaving, most people warm the hairs and skin with hot water or a hot towel. It is also common practice to place the shaver under hot running water in order to heat the blades just prior to stroking the blades over the skin in order to cut the hairs. However, the heat cutting performance of the blades lasts only a short time during the beginning of the shaving stroke process. Within seconds, the temperature of the skin surface, hairs, and blade are quickly reduced due to exposure to the ambient air temperature. Ideally, it is best to maintain the blades warm or hot throughout the shaving process.

One particular prior art blade heating invention, disclosed in U.S. Pat. No. 6,817,101 B1 to Bohmer, provides a shaving system with a continuously heated blade cartridge throughout the shaving stroke. Heating the blades is attained by applying a measured amount of electric current to the blade cartridge by means of conductors connected to each side of the blade cartridge and extended in the form of contacts at the connection of the blade cartridge to a razor handle.

The present invention improves on the past heated blade systems by providing efficient heat distribution across each razor blade in a series of razor blades within a blade cartridge. Specifically, the present invention uses two wire conductors that connect to the back edges of the blades. The spacing of the wire conductors helps to achieve more uniform heat distribution. The improved means of heating the razor blades of the present invention provides increased efficiency of battery power usage and a decrease in the amount of shaving cream required by the user during the shaving process.

SUMMARY OF THE INVENTION

A blade cartridge for a shaving razor contains a series of parallel blades, and at least two wire conductors of an electric circuit connected to the blades at spaced intervals to provide an electric current flow through the blades in a manner that provides more efficient heat distribution across the length of the blades. The two wire conductors may be connected to the blades at locations closer to the center of the blades or further apart, towards the ends of the blades, to achieve optimal heat distribution along the entire length of the blades. The ends of the blades may be held in place by staples or metal bands that are insulated from the electric circuit. A thin conductive film may be fitted to the opposite ends of the blades to insure conductivity throughout the entire length of each blade. A radiator effect of the heated blades causes the blades to become warmer when the blades are positioned against the user's skin and air flow between the blades is blocked. When the blades are removed from the skin surface, air is able to circulate between the blades which causes the temperature of the blades to be reduced, although they remain heated. Accordingly, the radiator effect provides an intuitive control of heat, wherein the user feels less heat when the blades are frequently removed from the skin or moved faster across the skin surface and more heat when the blades are moved slower across the skin surface and in contact with the skin for longer intervals. The blade heating system of the present invention is easily adapted to existing blade cartridge designs as a retrofit. The blade heating system may also be incorporated into a newly manufactured blade cartridge design.

OBJECTS AND ADVANTAGES OF THE INVENTION

Considering the foregoing, it is a primary object of the present invention to provide a blade heating system for a razor that more uniformly distributes heat energy across one or more blades within the blade cartridge of a razor to ensure more consistent heat along the entire length of the blades.

It is a further object of the present invention to provide a blade heating system in a razor that allows for intuitive control of blade heat.

It is still a further object of the present invention to provide an efficient blade heating system for a shaving razor that can be easily adapted to existing blade cartridge designs.

These and other objects and advantages of the present invention are more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the blade heating system of the present invention is shown and is generally indicated as 10.

Figure 1:
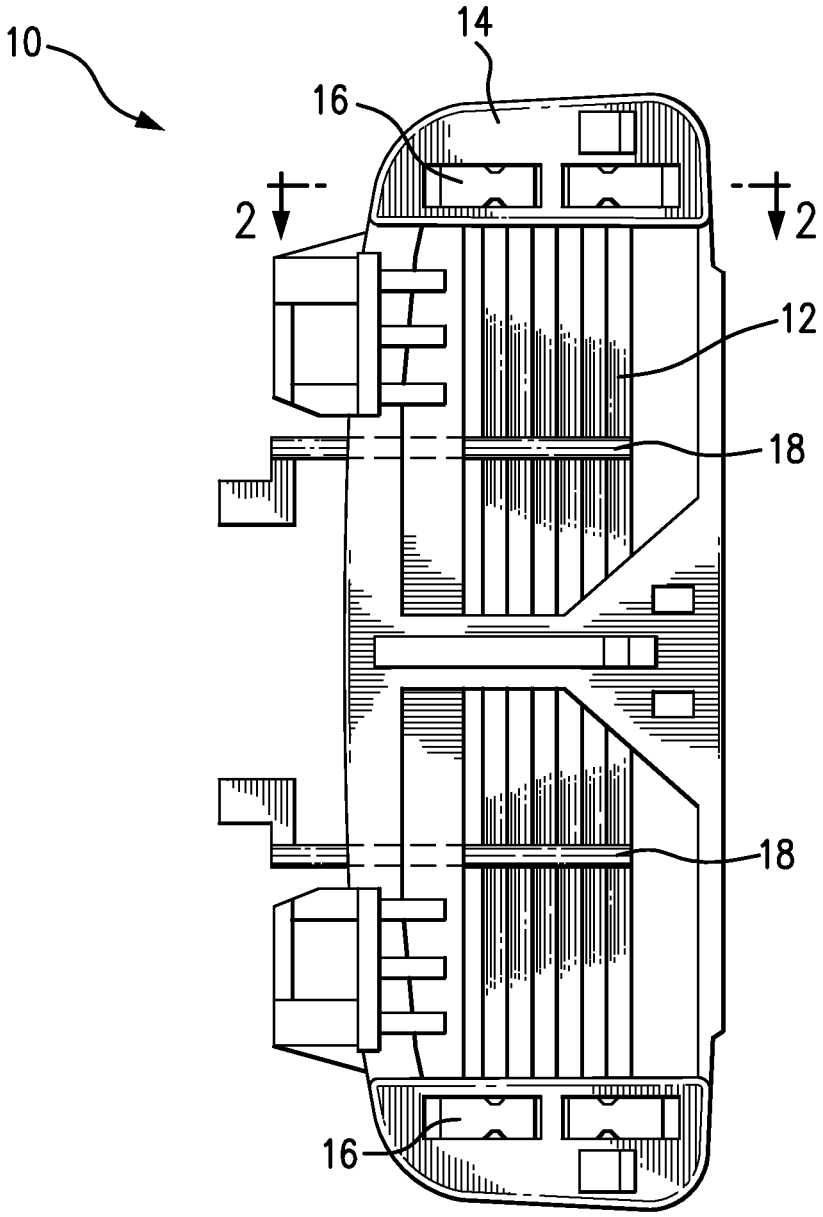
FIG. 1 is a bottom plan view of a blade cartridge according to a preferred embodiment of the blade heating system of the present invention, wherein the blade cartridge includes a series of razor blades, a pair of staples holding the blades in place within the blade cartridge, and two spaced metal conductors in contact with the back edges of the razor blades.

Referring to FIG. 1, the blade heating system 10 includes a series of razor blades 12 affixed in parallel relation to each other within a blade cartridge 14. In one embodiment, a pair of staples 16 located at opposite sides of the blade cartridge 14 hold the razor blades 12 in place.

Figure 2:
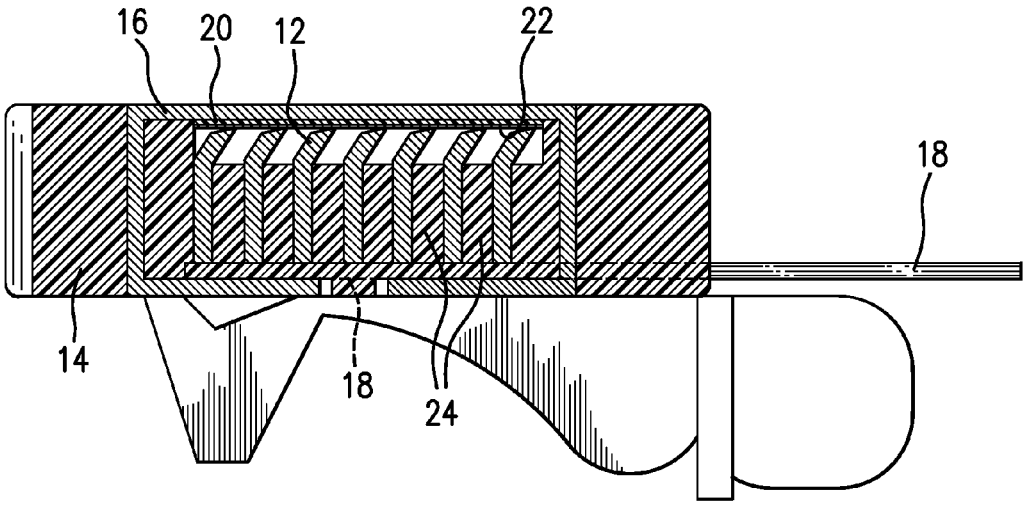
FIG. 2 is a cross-sectional view taken along the plane of the line 2-2 in FIG. 1 illustrating the blade heating system of the present invention and including the series of razor blades, a staple, an insulating material, a thin conductive film located between the staple and the blades, the metal wire conductor in contact with the back edges of the razor blades, a blade separator, and the blade cartridge housing.

Two or more spaced metal wire conductors 18 are positioned in contact with the back edges of one or more of the razor blades 12 to form a series circuit. When the wires are supplied with an electric current, heat is generated at the blades. The heat travels through the length of each blade 12 that is contacted by the wires so that the entire blade is heated. While the front cutting edges of the blades 12 have a protective coating for safety during the shaving process, the back edges of the blades 12 are not coated in order to preserve the conductive properties of the blades 12. As illustrated in FIG. 2, an insulating material 20 is placed between the blade surface and each staple 16 to prevent heating or overheating of the staples 16. A thin conductive film 22 can be added between the insulating material 20 and blades 12 so that the film 22 is in contact with the blades 12. This may help to promote better conductivity throughout the entire length of all of the blades in the cartridge. A blade separator 24 holds the blades 12 separated within the blade cartridge 14, maintaining the blades 12 at an optimally angled position for shaving. The contact points of the two wires may be closer to the center of the blades or further apart, towards the ends of the blades. The ideal spacing between these contact points of the two wires is that which achieves the best heat distribution throughout the entire lengths of the blades.

Figure 3:
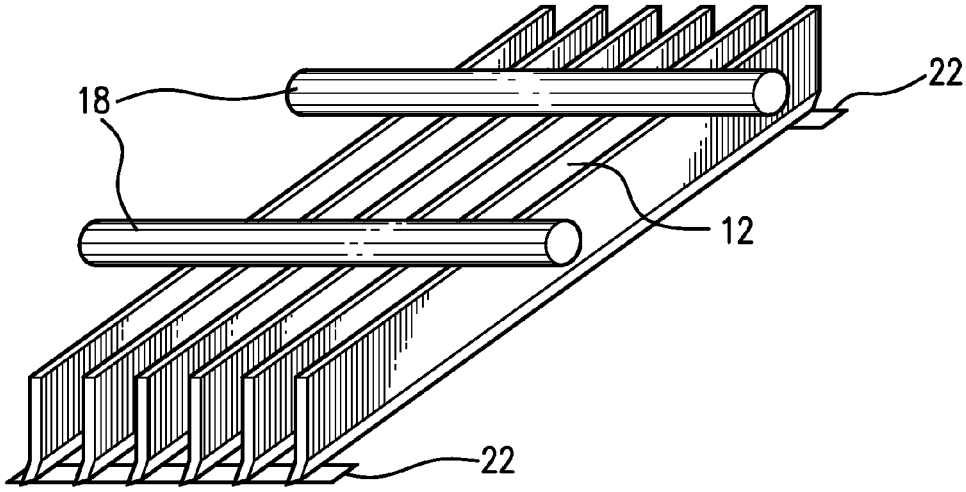
FIG. 3 is an isolated perspective illustration showing the two spaced metal wire conductors in contact with the back edges of the razor blades.

In a preferred embodiment, the spaced metal wires 18 are composed of steel or other electrically conductive material, the thin conductive film 22 is composed of aluminum or other electrically conductive material, and the razor blades 12 are composed of stainless steel. Dissimilar metals in contact with one another may help to promote greater heat levels and uniform heat distribution when supplied with an electric current. Moreover, the contact points of the dissimilar metals creates heat that may promote the radiator effect. Referring to FIG. 3, an electric current is applied to the spaced metal wires 18 and spreads across a series circuit created by the contact points of the spaced metal wires 18, the thin conductive film 22, and the blades 12. The multiple contact points increase the efficiency of the battery power required to maintain more uniform heating across the blades 12. Furthermore, the efficient heating across the blades 12 results in a decrease in the amount of shaving cream required during the shaving process. The blade heating system can be easily adapted to existing blade cartridge designs presently sold in the marketplace. Moreover, the razor may be provided with a thermostat switch to control electric current flow to the blades and, accordingly, the temperature of the blades.

Figure 4:
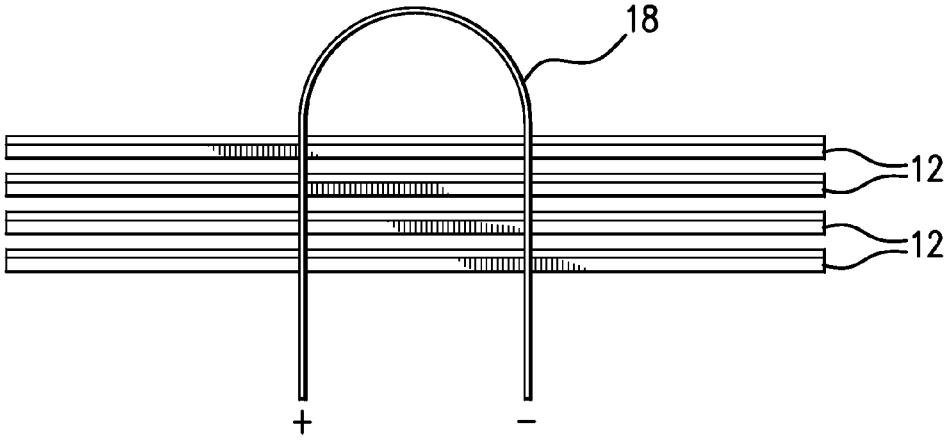
FIG. 4 is an isolated top plan view of the back edges of the multiple blades showing a single wire conductor arranged in a loop and contacting the back edges of the blades at spaced locations of each blade, according to an alternative embodiment of the invention.

FIG. 4 shows a further embodiment of the invention wherein a single conductor 18 is connected to the positive and negative terminals of the power source in a closed electrical circuit loop, and wherein the single conductor 18 is disposed in electrical conductive contact with the back edges of the blades 12 at spaced locations on each blade to provide electric current flow through each blade that is sufficient to heat each blade, or alternatively, select individual blades.

The radiator effect of the blade heating system allows for an inexpensive means for controlled heating of the blades. When the blades are not in contact with the user's skin, air is able to flow between the blades which keeps the blades cooler. When the blades contact the user's skin, air flow between the blades is restricted and the blades get hotter. This allows the user to achieve higher levels of blade temperature by holding the blades against the skin for longer periods of time. When a cooler temperature is desired, the user simply removes the blades from the skin to allow air flow between the blades.

While the present invention has been shown and described in accordance with a preferred embodiment, it is recognized that departures from the instant disclosure are contemplated within the spirit and scope of the present invention which are not to be limited except as defined in the following claims as interpreted under the Doctrine of Equivalents.

What is claimed is:

1. A razor blade heating system comprising:

at least one electrically conductive blade formed as a unitary body and being structured and disposed for receiving an electric current flow through said unitary body, and having a top side, a bottom side, a front cutting edge, at least one back non-cutting edge and a back surface between the at least one back non-cutting edge and the top side, and the top side extending from the front cutting edge to the at least one back non-cutting edge, the bottom side extending from the front cutting edge to the back surface, and the at least one electrically conductive blade further including opposite outboard ends;

a blade cartridge structured and configured for containing said at least one electrically conductive blade within said cartridge so that the cutting edge is operatively positioned for cutting hairs when the blade cartridge is moved along the skin surface of a user; and at least one electrically conductive wire held in contact with the at least one back non-cutting edge and the back surface of said at least one electrically conductive blade for delivering an electric current from a power source to the at least one back non-cutting edge and into the unitary body defining the at least one electrically conductive blade so that the electric current flows through said at least one electrically conductive blade and said at least one electrically conductive blade is heated across its entire length.

2. A razor blade heating system comprising:

a plurality of conductive blades each formed as a unitary body and being structured and disposed for receiving an electric current flow through said unitary body, and having a top side, a bottom side, a front cutting edge, at least one back non-cutting edge and a back surface between the at least one back non-cutting edge and the top side, and the top side extending from the front cutting edge to the at least one back non-cutting edge, the bottom side extending from the front cutting edge to the back surface, and the at least one electrically conductive blade further including opposite outboard ends;

a blade cartridge structured and configured for containing said plurality of electrically conductive blades within said cartridge so that the cutting edges of said plurality of electrically conductive blades are operably positioned in parallel, spaced relation for cutting hairs when the blade cartridge is moved along the skin surface of a user; and at least one electrically conductive wire held in contact with the at least one back non-cutting edge and the back surface of at least one of said electrically conductive blades for delivering an electric current from a power source to the at least one back non-cutting edge and into the unitary body defining the at least one of said plurality of the electrically conductive blades so that the electric current flows through the at least one of said plurality of electrically conductive blades and the at least one of said plurality of electrically conductive blades is heated across its entire length.

3. The razor blade heating system as recited in claim 2 further comprising:

said at least one electrically conductive wire held in contact with the at least one back non-cutting edge and the back surface of each of said plurality of electrically conductive blades for allowing the electric current to flow through each of said plurality of electrically conductive blades in a closed electric circuit and causing each of said plurality of electrically conductive blades to be heated across their entire length.

4. A razor blade heating system comprising:

a plurality of conductive blades each formed as a unitary body and being structured and disposed for receiving an electric current flow through said unitary body, and having a top side, a bottom side, a front a cutting edge, at least one back non-cutting edge and a back surface between the at least one back non-cutting edge and the top side, and the top side extending from the front cutting edge to the at least one back non-cutting edge, the bottom side extending from the front cutting edge to the back surface, and the at least one electrically conductive blade further including opposite outboard ends;

a blade cartridge structured and configured for containing said plurality of electrically conductive blades within said cartridge so that the cutting edges of said plurality of electrically conductive blades are operably positioned in parallel, spaced relation for cutting hairs when the blade cartridge is moved along the skin surface of a user; and a pair of electrically conductive wires each held in contact with the at least one back non-cutting edge of each of said plurality of electrically conductive blades for delivering an electric current flow from a power source to the at least one back non-cutting edge of each of said plurality of electrically conductive blades and into the unitary body defining each of the plurality of electrically conductive blades so that the electric current flows through said plurality of electrically conductive blades and said plurality of electrically conductive blades are heated across their entire length.

* * * * *